US011069276B2

(12) United States Patent
Lim et al.

(10) Patent No.: US 11,069,276 B2
(45) Date of Patent: Jul. 20, 2021

(54) DISPLAY APPARATUS AND METHOD OF DRIVING DISPLAY PANEL USING THE SAME

(71) Applicant: SAMSUNG DISPLAY CO., LTD., Yongin-si (KR)

(72) Inventors: Hyunho Lim, Jecheon-si (KR); Bongho Bae, Suwon-si (KR); Ok-Kwon Shin, Seoul (KR); Chongguk Lee, Seongnam-si (KR); Myeong Bin Lim, Hwaseong-si (KR); Sehui Jang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/741,346

(22) Filed: Jan. 13, 2020

(65) Prior Publication Data

US 2020/0234624 A1 Jul. 23, 2020

(30) Foreign Application Priority Data

Jan. 22, 2019 (KR) ..... 10-2019-0008139

(51) Int. Cl.
*G09G 3/20* (2006.01)

(52) U.S. Cl.
CPC ..... *G09G 3/20* (2013.01); *G09G 2300/0408* (2013.01); *G09G 2310/027* (2013.01); *G09G 2310/0291* (2013.01); *G09G 2320/0233* (2013.01); *G09G 2320/0276* (2013.01); *G09G 2320/0626* (2013.01); *G09G 2320/0673* (2013.01); *G09G 2330/023* (2013.01)

(58) Field of Classification Search
CPC ..... G09G 3/20; G09G 2320/0276; G09G 2320/0673; G09G 2320/0233; G09G 2310/0291; G09G 2300/0408; G09G 2330/023; G09G 2310/027; G09G 2320/0626; G09G 2330/021; G09G 2320/02; G09G 3/3208; G09G 3/36
See application file for complete search history.

(56) References Cited

U.S. PATENT DOCUMENTS 9,818,367 B2 11/2017 Lin et al.
10,854,127 B2 * 12/2020 You ..... G09G 3/2003
(Continued)

FOREIGN PATENT DOCUMENTS

KR 10-2015-0094872 8/2015
KR 10-2015-0127500 11/2015
(Continued)

*Primary Examiner* — Grant Sitta
(74) *Attorney, Agent, or Firm* — F. Chau & Associates, LLC

(57) ABSTRACT

A display apparatus includes a display panel, a gate driver, a data driver and a gamma reference voltage generator. The display panel is configured to display an image based on input image data. The gate driver is configured to output a gate signal to the display panel. The data driver is configured to output a data voltage to the display panel. The gamma reference voltage generator includes a plurality of gamma amplifiers having varied bias currents. The gamma reference voltage generator is configured to generate gamma reference voltages and to output the gamma reference voltages to the data driver.

23 Claims, 11 Drawing Sheets

| GAMMA AMP | BIAS CURRENT |
|---|---|
| AMG1 | 111 |
| AMG2 | 110 |
| AMG3 | 100 |
| AMG4 | 010 |
| AMG5 | 000 |
| AMG6 | 000 |
| AMG7 | 010 |
| AMG8 | 100 |
| AMG9 | 110 |
| AMG10 | 111 |

(56) References Cited

U.S. PATENT DOCUMENTS

| | | | | |
|---|---|---|---|---|
| 2006/0103466 | A1* | 5/2006 | Shah | H03F 1/0288 330/295 |
| 2011/0298781 | A1* | 12/2011 | Park | G09G 3/3688 345/212 |
| 2015/0130851 | A1* | 5/2015 | Jeong | G09G 3/20 345/690 |
| 2015/0325200 | A1* | 11/2015 | Rho | G09G 3/3688 345/212 |
| 2016/0098959 | A1* | 4/2016 | Moon | G09G 3/3696 345/205 |
| 2016/0203777 | A1* | 7/2016 | Brahma | G09G 3/2096 345/211 |
| 2016/0275891 | A1* | 9/2016 | Teranishi | G09G 3/2018 |
| 2016/0343292 | A1* | 11/2016 | Zheng | G06F 1/3265 |
| 2018/0090083 | A1* | 3/2018 | Kim | G09G 3/3677 |
| 2018/0096666 | A1* | 4/2018 | Chung | G09G 3/3696 |

FOREIGN PATENT DOCUMENTS

| | | |
|---|---|---|
| KR | 10-2016-0041103 | 4/2016 |
| KR | 10-2016-0087455 | 7/2016 |
| KR | 10-1654355 | 8/2016 |

* cited by examiner

FIG. 6

| GAMMA AMP | BIAS CURRENT |
|---|---|
| AMG1 | 111 |
| AMG2 | 110 |
| AMG3 | 100 |
| AMG4 | 010 |
| AMG5 | 000 |
| AMG6 | 000 |
| AMG7 | 010 |
| AMG8 | 100 |
| AMG9 | 110 |
| AMG10 | 111 |

FIG. 8

| GAMMA AMP | BIAS CURRENT(100%) | BIAS CURRENT(50%) |
|---|---|---|
| AMG1 | 111 | 110 |
| AMG2 | 110 | 100 |
| AMG3 | 100 | 010 |
| AMG4 | 010 | 000 |
| AMG5 | 000 | 000 |
| AMG6 | 000 | 000 |
| AMG7 | 010 | 000 |
| AMG8 | 100 | 010 |
| AMG9 | 110 | 100 |
| AMG10 | 111 | 110 |

FIG. 9

| GAMMA AMP | BIAS CURRENT (MIXED COLOR) | BIAS CURRENT (SINGLE COLOR) |
|---|---|---|
| AMG1 | 111 | 000 |
| AMG2 | 110 | 000 |
| AMG3 | 100 | 000 |
| AMG4 | 010 | 000 |
| AMG5 | 000 | 000 |
| AMG6 | 000 | 000 |
| AMG7 | 010 | 000 |
| AMG8 | 100 | 000 |
| AMG9 | 110 | 000 |
| AMG10 | 111 | 000 |

DISPLAY APPARATUS AND METHOD OF DRIVING DISPLAY PANEL USING THE SAME

CROSS-REFERENCE TO RELATED APPLICATION

This U.S. non-provisional application claims priority under 35 U.S.C. § 119 to Korean Patent Application No. 10-2019-0008139, filed on Jan. 22, 2019 in the Korean Intellectual Property Office KIPO, the disclosure of which is incorporated by reference in its entirety herein.

BACKGROUND

1. Technical Field

Exemplary embodiments of the present inventive concept relate to a display apparatus and a method of driving a display panel of the display apparatus, and more particularly to a display apparatus that uses less power and a method of driving a display panel of the display apparatus using less power.

2. Discussion of Related Art

A display apparatus may include a display panel and a display panel driver to drive the display panel. The display panel may include a plurality of gate lines, a plurality of data lines and a plurality of pixels. The display panel driver may include a gate driver, a data driver, a gamma reference voltage generator and a driving controller. The gate driver outputs gate signals to the gate lines. The data driver outputs data voltages to the data lines. The gamma reference voltage generator outputs a gamma reference voltage to the data driver. The driving controller controls the gate driver and the data driver.

The gamma reference voltage generator may include a plurality of gamma amplifiers. When a level of bias currents of the gamma amplifiers are low, charging rates of the pixels may be insufficient to prevent a display quality of the display panel from deteriorating. While the bias currents can be increased to a higher level to improve the display quality, such causes the display apparatus to use more power.

SUMMARY

At least one exemplary embodiment of the present inventive concept provides a display apparatus capable of adaptively setting bias currents of gamma amplifiers to reduce power consumption.

At least one exemplary embodiment of the present inventive concept also provides a method of driving a display panel using the above-mentioned display apparatus.

In an exemplary embodiment of a display apparatus according to the present inventive concept, the display apparatus includes a display panel, a gate driver, a data driver and a gamma reference voltage generator. The display panel is configured to display an image based on input image data. The gate driver is configured to output a gate signal to the display panel. The data driver is configured to output a data voltage to the display panel. The gamma reference voltage generator includes a plurality of gamma amplifiers having varied bias currents. The gamma reference voltage generator is configured to generate gamma reference voltages and to output the gamma reference voltages to the data driver.

In an exemplary embodiment, the gamma amplifiers include a minimum gamma amplifier configured to output a minimum gamma reference voltage, a maximum gamma amplifier configured to output a maximum gamma reference voltage and a middle gamma amplifier configured to output a middle gamma reference voltage between the minimum gamma reference voltage and the maximum gamma reference voltage. A bias current of the maximum gamma amplifier may be greater than a bias current of the middle gamma amplifier. A bias current of the minimum gamma amplifier may be greater than the bias current of the middle gamma amplifier.

In an exemplary embodiment, the bias currents of the gamma amplifiers are varied according to a preset luminance of the display panel.

In an exemplary embodiment, when the preset luminance of the display panel is a first luminance value, the bias current of a given one of the gamma amplifiers is a second current value lower than the first luminance value. When the preset luminance of the display panel is a second luminance value lower than the first luminance value, the bias current of the one given gamma amplifier is a second current value lower than the first current value.

In an exemplary embodiment, the bias currents of the gamma amplifiers are varied according to grayscale values of the input image data.

In an exemplary embodiment, when a difference between a maximum grayscale value of the input image data and a minimum grayscale value of the input image data is a first difference value, the bias current of a given one of the gamma amplifiers is a first difference value. When the difference between the maximum grayscale value of the input image data and the minimum grayscale value of the input image data is a second difference value lower than the first difference value, the bias current of the given gamma amplifier is a second current value lower than the first current value.

In an exemplary embodiment, the difference between the maximum gray scale value of the input image data and the minimum grayscale value of the input image data is determined in a unit of a frame of the input image data, and the bias currents of the gamma amplifiers are updated in the unit of the frame.

In an exemplary embodiment, the difference between the maximum gray scale value of the input image data and the minimum grayscale value of the input image data is determined in a unit of a display line of the input image data, and the bias currents of the gamma amplifiers are updated in the unit of the display line.

In an exemplary embodiment, the gamma amplifiers include first gamma amplifiers configured to generate first gamma reference voltages corresponding to a first color image, second gamma amplifiers configured to generate second gamma reference voltages corresponding to a second color image and third gamma amplifiers configured to generate third gamma reference voltages corresponding to a third color image. The first gamma amplifiers may have varied bias currents. The second gamma amplifiers may have varied bias currents. The third gamma amplifiers may have varied bias currents.

In an exemplary embodiment, the gamma reference voltage generator may further include a plurality of resistor strings and a plurality of registers disposed between the gamma amplifiers and the resistor strings. An output voltage of a given one the gamma amplifiers may be determined by a value stored in a corresponding one of the registers.

In an exemplary embodiment, the gamma reference voltage generator includes a master gamma reference voltage generator comprising the plurality of gamma amplifiers as master gamma amplifiers configured to output master gamma reference voltages and a slave gamma reference voltage generator comprising a plurality of slave gamma amplifiers configured to receive the master gamma reference voltages and to output the master gamma reference voltages to the data driver and a plurality of slave resistor strings disposed between the slave gamma amplifiers.

In an exemplary embodiment, the master gamma amplifiers correspond to the slave gamma amplifiers one to one.

In an exemplary embodiment, the master gamma amplifier and the slave gamma amplifier which correspond to each other have the same bias current.

In an exemplary embodiment, the gamma reference voltage generator and the data driver form a single integrated data driver.

In an exemplary embodiment of a method of driving a display panel according to the present inventive concept, the method includes outputting a gate signal to a display panel, generating a plurality of gamma reference voltages using a plurality of gamma amplifiers having varied bias currents and outputting a data voltage to the display panel based on input image data and the gamma reference voltages.

In an exemplary embodiment, the gamma amplifiers include a minimum gamma amplifier configured to output a minimum gamma reference voltage, a maximum gamma amplifier configured to output a maximum gamma reference voltage and a middle gamma amplifier configured to output a middle gamma reference voltage between the minimum gamma reference voltage and the maximum gamma reference voltage. A bias current of the maximum gamma amplifier may be greater than a bias current of the middle gamma amplifier. A bias current of the minimum gamma amplifier may be greater than the bias current of the middle gamma amplifier.

In an exemplary embodiment, the bias currents of the gamma amplifiers are varied according to a preset luminance setting of the display panel.

In an exemplary embodiment, when the preset luminance of the display panel is a first luminance value, the bias current of a given one of the gamma amplifiers is a first current value. When the preset luminance of the display panel is a second luminance value lower than the first luminance value, the bias current of the given gamma amplifier is lower than the first current value.

In an exemplary embodiment, the bias currents of the gamma amplifiers are varied according to grayscale values of the input image data.

In an exemplary embodiment, when a difference between a maximum grayscale value of the input image data and a minimum grayscale value of the input image data is a first difference value, the bias current of a given one of the gamma amplifiers is a first current value. When the difference between the maximum grayscale value of the input image data and the minimum grayscale value of the input image data is a second difference value lower than the first difference value, the bias current of the given gamma amplifier is lower than the first current value.

According to the display apparatus and the method of driving the display panel using the display apparatus, the bias current of the gamma amplifier is adjusted according to a data range of an image displayed on the display panel so that the display quality of the display panel may not be deteriorated and the power consumption of the display apparatus may be reduced.

In an exemplary embodiment of a driving controller for driving a display panel of a display apparatus according to the present inventive concept, the driving controller includes a gamma reference voltage generator and a data driver. The gamma reference voltage generator is configured to generate gamma reference voltages and to output the gamma reference voltages. The data driver converts image data into data voltages having an analog type using the gamma reference voltages. The gamma reference voltage generator includes: a minimum gamma amplifier configured to output a minimum gamma reference voltage of gamma reference voltages; a maximum gamma amplifier configured to output a maximum gamma reference voltage gamma reference voltages; a middle gamma amplifier configured to output a middle gamma reference voltage of the gamma reference voltages between the minimum gamma reference voltage and the maximum gamma reference voltage, where a bias current of the maximum gamma amplifier is greater than a bias current of the middle gamma amplifier and a bias current of the minimum gamma amplifier is greater than the bias current of the middle gamma amplifier.

In an exemplary embodiment, the bias currents are varied according to a preset luminance of the display panel.

In an exemplary embodiment, the bias currents are varied according to grayscale values of the image data.

BRIEF DESCRIPTION OF THE DRAWINGS

The present inventive concept will become more apparent by describing exemplary embodiments thereof in detail with reference to the accompanying drawings, in which:

FIG. 6 is a table illustrating a method of setting bias currents of gamma amplifiers of FIG. 4 according to an exemplary embodiment of the present inventive concept;

FIG. 8 is a table illustrating a method of setting bias currents of gamma amplifiers according to an exemplary embodiment of the present inventive concept;

FIG. 9 is a table illustrating a method of setting bias currents of gamma amplifiers according to an exemplary embodiment of the present inventive concept;

DETAILED DESCRIPTION OF EMBODIMENTS OF THE INVENTIVE CONCEPT

Hereinafter, exemplary embodiment of the present inventive concept will be explained in detail with reference to the accompanying drawings.

Figure 1:
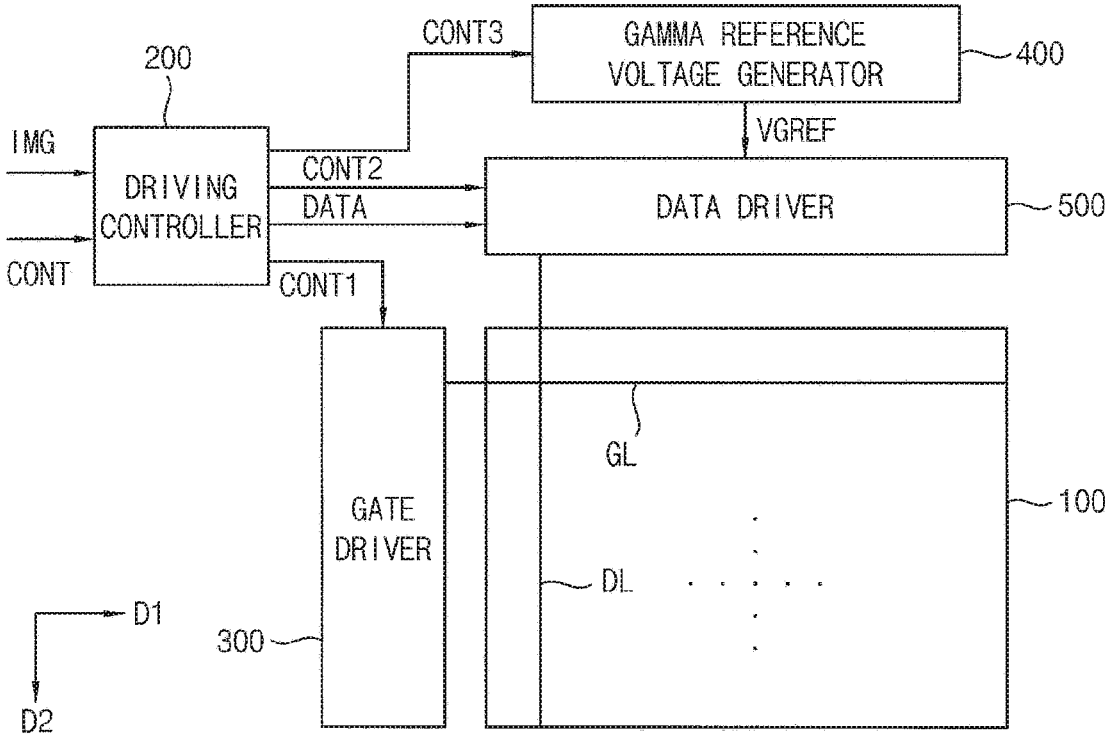
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200 (e.g., a driving control circuit), a gate driver 300 (a gate driving circuit), a gamma reference voltage generator 400 and a data driver 500 (e.g., a data driving circuit).

For example, the driving controller 200 and the data driver 500 may be integrally formed. For example, the driving controller 200, the gamma reference voltage generator 400 and the data driver 500 may be integrally formed. For example, the driving controller 200, the gate driver 300, the gamma reference voltage generator 400 and the data driver 500 may be integrally formed.

The display panel 100 includes a display region and a peripheral region adjacent to the display region. For example, the peripheral region could surround the display region.

For example, the display panel 100 may be an organic light emitting diode display panel including organic light emitting diodes. Alternatively, the display panel 100 may be a liquid crystal display panel including liquid crystal molecules.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The data enable signal may include when the input image data IMG is valid. The input control signal CONT may further include a vertical synchronizing signal and a horizontal synchronizing signal. The vertical synchronizing signal (VSYNC) may indicate a time when a next frame of the image data IMG is to be output to the display panel 100. The horizontal synchronizing signal (HSYNC) may indicate a time when a next row of the image data IMG is to be output to a row of the display panel 100.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 (e.g., a timing controller) generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA. For example, the data driver 500 may adjust a level of the data signal DATA based on the gamma reference voltage VGREF.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
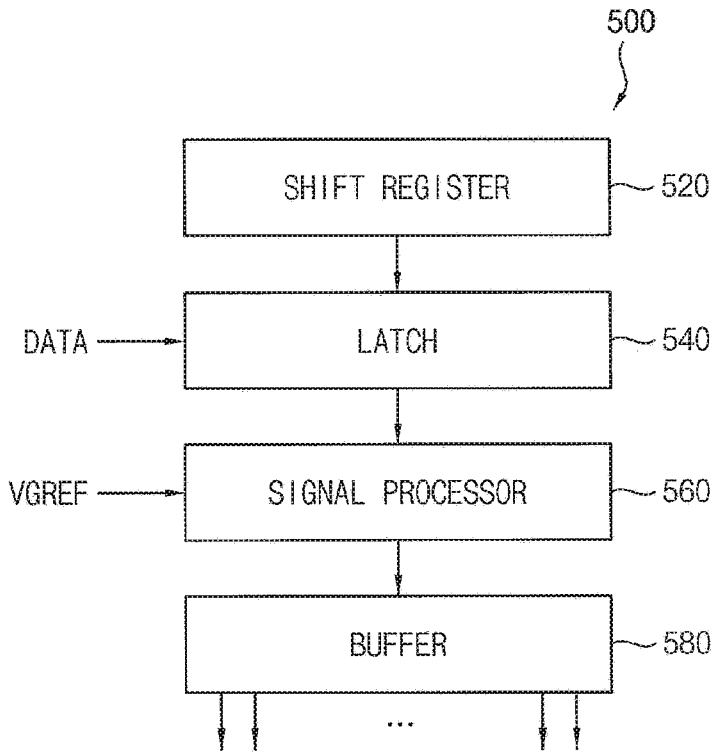
FIG. 2 is a block diagram illustrating a data driver of FIG. 1.
Figure 3:
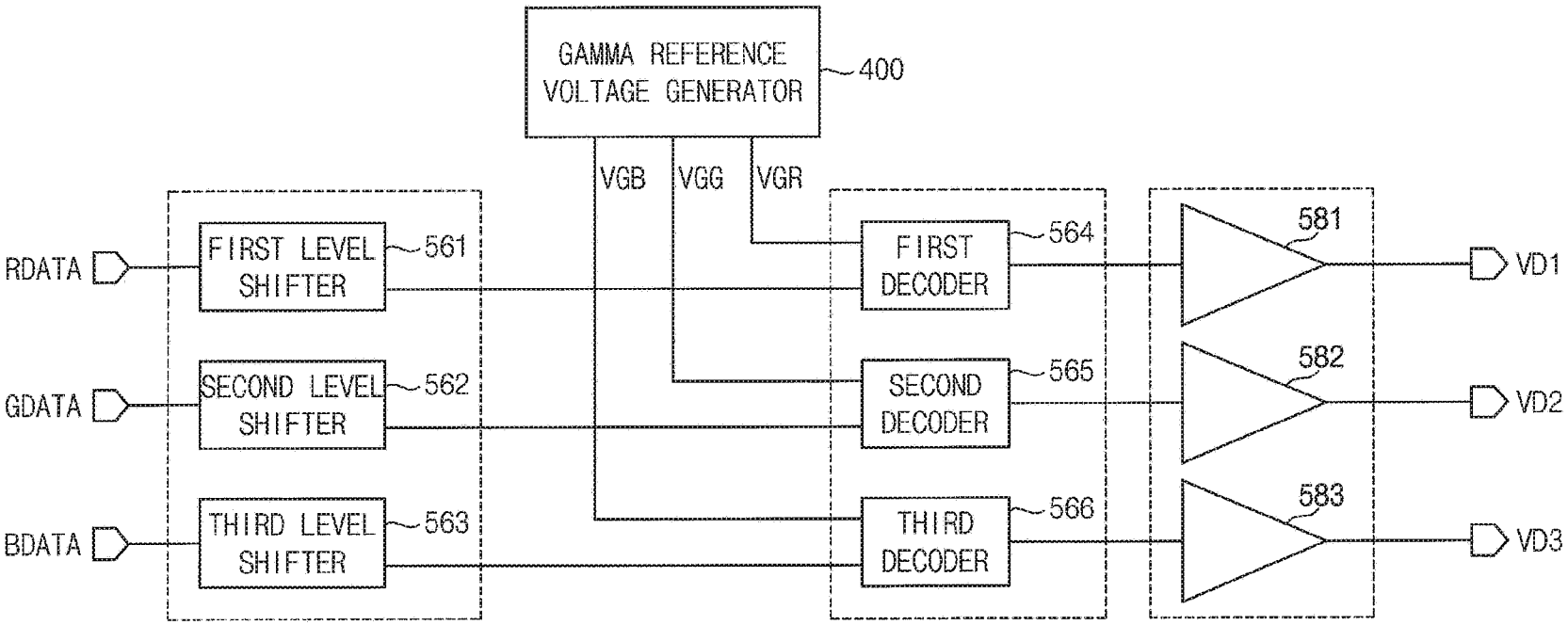
FIG. 3 is a block diagram illustrating a signal processor of FIG. 2.

FIG. 2 is a block diagram illustrating an embodiment of the data driver 500 of FIG. 1. FIG. 3 is a block diagram illustrating an embodiment of a signal processor 560 of FIG. 2.

Referring to FIGS. 1 to 3, the data driver 500 includes a shift resistor 520, a latch 540 (e.g., a latch circuit), a signal processor 560 and a buffer 580.

The shift resistor 520 outputs a latch pulse to the latch 540.

The latch 540 receives the data signals DATA from the driving controller 200. The latch 540 temporarily stores the data signals DATA, and then outputs the data signals DATA in response to the latch pulse.

The signal processor 560 converts the data signal DATA having a digital type into the data voltages having an analog type based on the data signal DATA and the gamma reference voltage VGREF, and outputs the data voltages having the analog type.

The buffer 580 buffers the data voltages outputted from the signal processor 560, and outputs the data voltages to the data lines DL of the display panel 100.

In exemplary embodiment shown in FIG. 3, the signal processor 560 includes a plurality of level shifters 561, 562 and 563 for increasing a level of the data signal DATA. For example, at least one of the level shifters 561, 562, ad 563 may be implemented by a circuit that translates a signal from one logic level or voltage domain a different logic level or voltage domain.

In the exemplary embodiment shown in FIG. 3, the signal processor 560 further includes a plurality of decoders 564, 565 and 566 (e.g., decoding circuits). The decoders 564, 565 and 566 may output a data voltage to the buffer 580, where the data voltage is generated by the decoders 564-566 matching the data signal DATA received from the level shifter 561, 562 and 563 to the gamma reference voltage VGREF.

In the exemplary embodiment shown in FIG. 3, the buffer 580 includes a plurality of output buffers 581, 582 and 583 respectively connected to the data lines DL.

For example, the gamma reference voltage generator 400 may generate first gamma reference voltages VGR corresponding to a first color, second gamma reference voltages VGG corresponding to a second color and third gamma reference voltages VGB corresponding to a third color. For example, the first color may be red. For example, the second color may be green. For example, the third color may be blue.

In an exemplary embodiment, a first level shifter 561 of the signal processor 560 increases a level of a first data signal RDATA of the first color and a first decoder 564 outputs a first data voltage VD1 to the buffer 580, where the first data voltage VD1 is generated by the first decoder 564 matching the first data signal RDATA to the first gamma reference voltage VGR.

In an exemplary embodiment, a second level shifter 562 of the signal processor 560 increases a level of a second data signal GDATA of the second color and a second decoder 565 outputs a second data voltage VD2 to the buffer 580, where the second data voltage VD2 is generated by the second decoder 565 matching the second data signal GDATA to the second gamma reference voltage VGG.

In an exemplary embodiment, a third level shifter 563 of the signal processor 560 increases a level of a third data signal BDATA of the third color and a third decoder 566 outputs a third data voltage VD3 to the buffer 580, where the third data voltage VD3 is generated by the third decoder 566 matching the third data signal BDATA to the third gamma reference voltage VGB.

Figure 4:
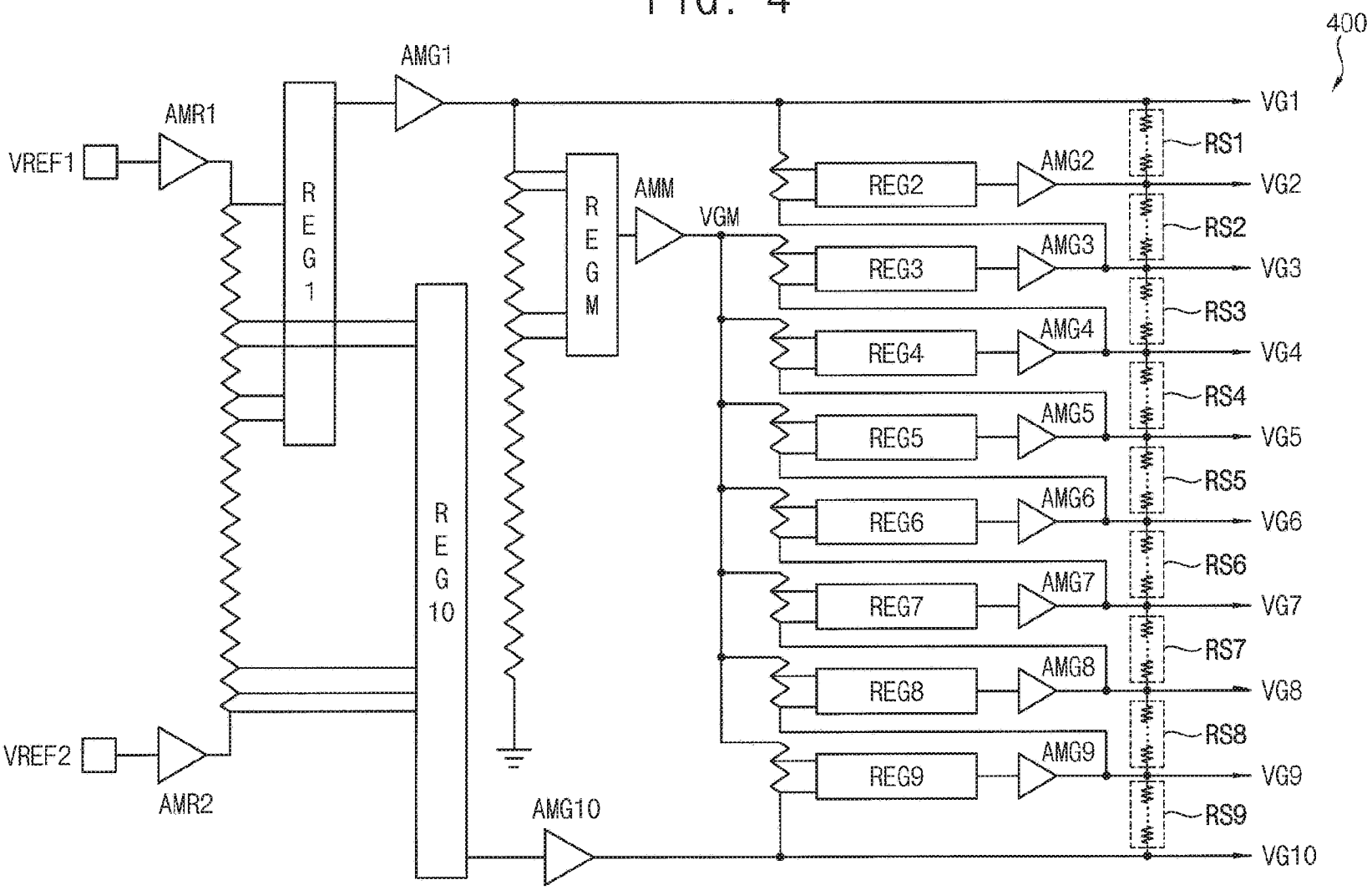
FIG. 4 is a circuit diagram illustrating a gamma reference voltage generator of FIG. 1 according to an exemplary embodiment of the present inventive concept.
Figure 5:
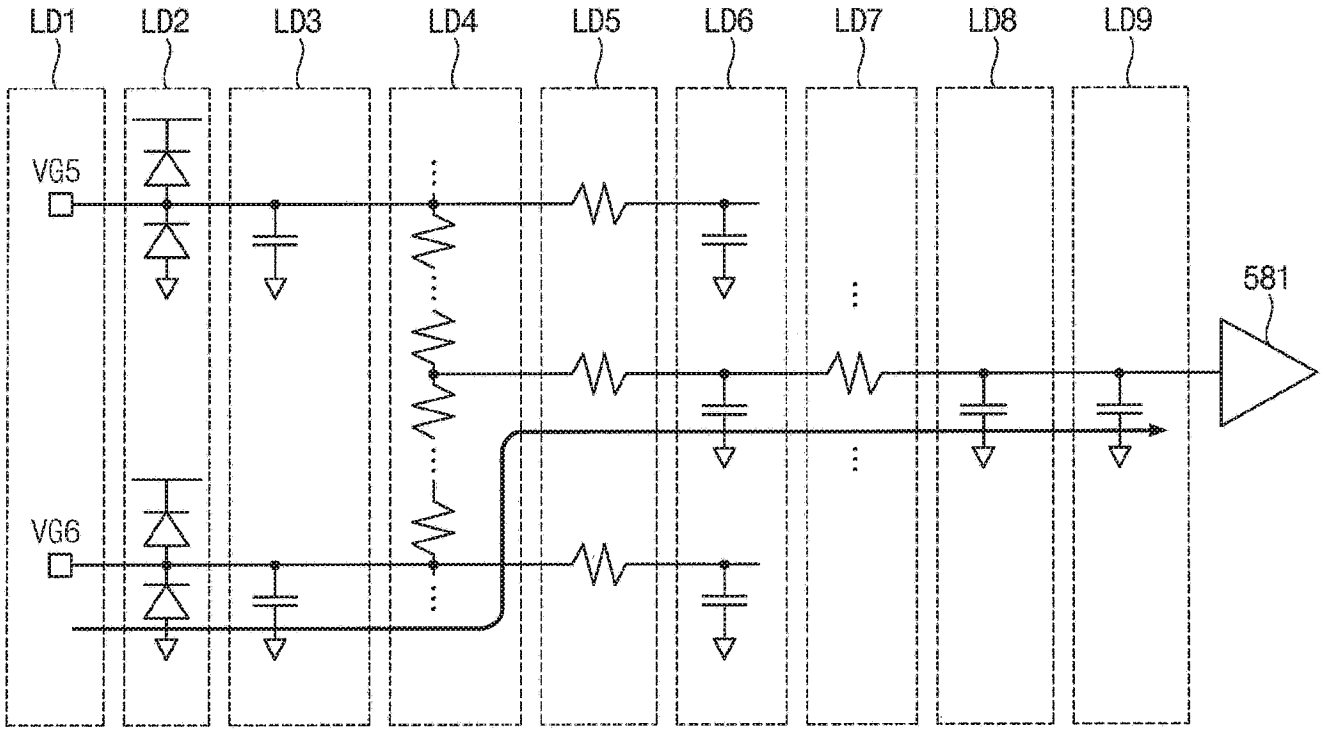
FIG. 5 is a conceptual diagram illustrating a load from the gamma reference voltage generator of FIG. 1 to an output buffer of the data driver of FIG. 1.

FIG. 4 is a circuit diagram illustrating the gamma reference voltage generator 400 of FIG. 1 according to an exemplary embodiment of the inventive concept. FIG. 5 is a conceptual diagram illustrating a load from the gamma reference voltage generator 400 of FIG. 1 to an output buffer of the data driver 500 of FIG. 1. FIG. 6 is a table illustrating a method of setting bias currents of gamma amplifiers AMG1 to AMG10 of FIG. 4.

Referring to FIGS. 1 to 6, the gamma reference voltage generator 400 includes a plurality of gamma amplifiers AMR1, AMR2, AMM, AMG1 to AMG10, a plurality of resistor strings and a plurality of registers REGM, REG1 to REG10 disposed between the gamma amplifiers AMR1, AMR2, AMM, AMG1 to AMG10 and the resistor strings.

A first reference voltage VREF1 is applied to a first input gamma amplifier AMR1 of the gamma reference voltage generator 400. A second reference voltage VREF2 is applied to a second input gamma amplifier AMR2 of the gamma reference voltage generator 400. The gamma reference voltages VG1 to VG10 may be generated based on the first reference voltage VREF1 and the second reference voltage VREF2. In an embodiment, the first and second reference voltages VREF1 and VREF2 differ from one another. In an embodiment, the gamma reference voltages VG1 to VG10 are between the first reference voltage VREF1 and the second reference voltage VREF2.

The gamma reference voltages VG1 to VG10 may be determined by voltage division by the resistor strings in the gamma reference voltage generator 400. The gamma reference voltages VG1 to VG10 may correspond to the gamma reference voltages VGR corresponding to the first color image, the gamma reference voltages VGG corresponding to the second color image, or the gamma reference voltages VGB corresponding to the third color image. The elements within FIG. 4 may be duplicated so that VGR, VGG, and VGB are generated together, or the elements within FIG. 4 may be driven at different times to generate VGR, VGG, and VGB at different times.

A first gamma voltage VG1 outputted from a first gamma amplifier AMG1 is generated by a value of a first register REG1 and based on the first reference voltage VREF1 and the second reference voltage VREF2. The first register REG1 may be disposed between a resistor string adjacent the first register REG1 and the first gamma amplifier AMG1.

A tenth gamma voltage VG10 outputted from a tenth gamma amplifier AMG10 is generated by a value of a tenth register REG10 and based on the first reference voltage VREF1 and the second reference voltage VREF2. The tenth register REG10 may be disposed between a resistor string adjacent the tenth register REG10 and the tenth gamma amplifier AMG10.

A temporary gamma voltage VGM outputted from a temporary gamma amplifier AMM is generated by a value of an intermediate register REGM and based on the first gamma voltage VG1. The intermediate register REGM may be disposed between a resistor string adjacent the intermediate register REGM and the temporary gamma amplifier AMM.

A ninth gamma voltage VG9 outputted from a ninth gamma amplifier AMG9 is generated by a value of a ninth register REG9 and based on the temporary gamma voltage VGM and the tenth gamma voltage VG10. The ninth register REG9 may be disposed between a resistor string adjacent the ninth register REG9 and the ninth gamma amplifier AMG9.

An eighth gamma voltage VG8 outputted from an eighth gamma amplifier AMG8 is generated by a value of an eighth register REG8 and based on the temporary gamma voltage VGM and the ninth gamma voltage VG9. The eighth register REG8 may be disposed between a resistor string adjacent to the eighth register REG8 and the eighth gamma amplifier AMG8.

A seventh gamma voltage VG7 outputted from a seventh gamma amplifier AMG7 is generated by a value of a seventh register REG7 and based on the temporary gamma voltage VGM and the eighth gamma voltage VG8. The seventh register REG7 may be disposed between a resistor string adjacent the seventh register REG7 and the seventh gamma amplifier AMG7.

A sixth gamma voltage VG6 outputted from a sixth gamma amplifier AMG6 is generated by a value of a sixth register REG6 and based on the temporary gamma voltage VGM and the seventh gamma voltage VG7. The sixth register REG6 may be disposed between a resistor string adjacent to the sixth register REG6 and the sixth gamma amplifier AMG6.

A fifth gamma voltage VG5 outputted from a fifth gamma amplifier AMG5 is generated by a value of a fifth register REG5 and based on the temporary gamma voltage VGM and the sixth gamma voltage VG6. The fifth register REG5 may be disposed between a resistor string adjacent the fifth register REG5 and the fifth gamma amplifier AMG5.

A fourth gamma voltage VG4 outputted from a fourth gamma amplifier AMG4 is generated by a value of a fourth register REG4 and based on the temporary gamma voltage VGM and the fifth gamma voltage VG5. The fourth register REG4 may be disposed between a resistor string adjacent the fourth register REG4 and the fourth gamma amplifier AMG4.

A third gamma voltage VG3 outputted from a third gamma amplifier AMG3 is generated by a value of a third register REG3 and based on the temporary gamma voltage VGM and the fourth gamma voltage VG4. The third register REG3 may be disposed between a resistor string adjacent the third register REG3 and the third gamma amplifier AMG3.

A second gamma voltage VG2 outputted from a second gamma amplifier AMG2 may be generated by a value of a second register REG2 and based on the first gamma voltage VG1 and the third gamma voltage VG3. The second register REG2 may be disposed between a resistor string adjacent to the second register REG2 and the second gamma amplifier AMG2.

For example, the first gamma voltage VG1 may be a minimum gamma reference voltage having a minimum level among the gamma reference voltages (e.g. the first to tenth gamma voltages) VG1 to VG10. For example, the tenth gamma voltage VG10 may be a maximum gamma reference voltage having a maximum level among the gamma reference voltages (e.g. the first to tenth gamma voltages) VG1 to VG10.

For example, when the data signal DATA is an eight-bit signal, the gamma reference voltage generator 400 may output 256 different gamma reference voltages. For example, when the data signal DATA is an eight-bit signal, the data signal DATA may represent a zero grayscale value to a 255 grayscale value and the first to tenth gamma voltages VG1 to VG10 may be V0, V3, V11, V23, V35, V51, V87, V151, V203 and V255 corresponding to a zero grayscale value, a 3 grayscale value, an 11 grayscale value, a 23 grayscale value, a 35 grayscale value, a 51 grayscale value, a 87 grayscale value, a 151 grayscale value, a 203 grayscale value and a 255 grayscale value.

A first output resistor string RS1 is disposed between the first gamma amplifier AMG1 and the second gamma amplifier AMG2 and outputs gamma voltages between the first gamma voltage VG1 and the second gamma voltage VG2 by voltage division. When the first gamma voltage VG1 is V0 corresponding to a zero grayscale value and the second gamma voltage VG2 is V3 corresponding to a 3 grayscale value, the first output resistor string RS1 may output the gamma voltages V1 and V2 which respectively correspond to a 1 grayscale value and a 2 grayscale value. For example, the resistor string RS1 could include a pair of resistors, where a voltage across a resistor of the pair is V1 and a voltage across the other resistor of the pair is V2.

A second output resistor string RS2 is disposed between the second gamma amplifier AMG2 and the third gamma amplifier AMG3 and outputs gamma voltages between the second gamma voltage VG2 and the third gamma voltage VG3 by voltage division. When the second gamma voltage VG2 is V3 corresponding to a 3 grayscale value and the third gamma voltage VG3 is V11 corresponding to an 11 grayscale value, the second output resistor string RS2 may output the gamma voltages V4 to V10 which respectively correspond to 4 to 10 grayscale values.

A third output resistor string RS3 is disposed between the third gamma amplifier AMG3 and the fourth gamma amplifier AMG4 and outputs gamma voltages between the third gamma voltage VG3 and the fourth gamma voltage VG4 by voltage division. When the third gamma voltage VG3 is V11 corresponding to an 11 grayscale value and the fourth gamma voltage VG4 is V23 corresponding to a 23 grayscale value, the third output resistor string RS3 outputs the gamma voltages V12 to V22 which respectively correspond to 12 to 22 grayscale values.

Similar to the manner above explained way, fourth to ninth output resistor strings RS4 to RS9 may be disposed between the fourth gamma amplifier AMG4 to the tenth gamma amplifier AMG10.

FIG. 5 may represent a load from the gamma amplifier to the output buffer of the data driver 500. A first load LD1 may represent a load of a pad of the gamma amplifier, a second load LD2 may represent an electrostatic discharge (ESD) protection load, a third load LD3 may represent a load from the pad to the gamma resistor string, a fourth load LD4 may represent a resistance of the gamma resistor string, a fifth load LD5 may represent a protection resistance, a sixth load LD6 may represent a load from the gamma resistor string to the decoder (e.g., the first decoder 564) of the data driver 500, a seventh load LD7 may represent a modeling resistance of the decoder, an eighth load LD8 may represent a load from the decoder to the output buffer (e.g. the first output buffer 581) and a ninth load LD9 may represent an input load of the output buffer.

In an exemplary embodiment of the inventive concept, the gamma amplifiers (e.g. AMG1 to AMG10) of the gamma reference voltage generator 400 are set to have varied bias currents. When the bias current is high, the power consumption of the display apparatus may be increased by the first to ninth loads LD1 to LD9. When the bias current is low, the power consumption of the display apparatus may be reduced by the first to ninth loads LD1 to LD9. However, when the bias current is lower than a desired level, the output of the data voltage may be delayed by the first to ninth loads LD1 to LD9 so that the display panel 100 does not display a desired image.

In an exemplary embodiment, the gamma reference voltage generator 400 includes a minimum gamma amplifier (e.g. AMG1) outputting the minimum gamma reference voltage (e.g. VG1), a maximum gamma amplifier (e.g. AMG10) outputting the maximum gamma reference voltage (e.g. VG10), and a middle gamma amplifier (e.g. AMG5) outputting a middle gamma reference voltage (e.g. VG5) between the minimum gamma reference voltage (e.g. VG1) and the maximum gamma reference voltage (e.g. VG10).

In an exemplary embodiment, the bias current (e.g., a current corresponding to a binary number of "111") of the maximum gamma amplifier (e.g., AMG10) is greater than the bias current (e.g., a current corresponding to a binary number of "000") of the middle gamma amplifier (e.g., AMG5). In addition, in an exemplary embodiment, the bias current (e.g., a current corresponding to a binary number of "111") of the minimum gamma amplifier (e.g., AMG1) is greater than the bias current (e.g., a current corresponding to a binary number of "000") of the middle gamma amplifier (e.g., AMG5).

In an exemplary embodiment, the bias current of the gamma amplifiers gradually increases from the middle gamma amplifier to the maximum gamma amplifier. In an exemplary embodiment, the bias current of the gamma amplifiers gradually increases from the middle gamma amplifier to the minimum gamma amplifier.

As shown in FIG. 6, the bias current of the gamma amplifier may be set by a binary register value having three binary numbers. The binary register value is outputted from the driving controller 200 to the gamma voltage generator 400 to determine the bias current. When the binary register value is high, the bias current of the gamma amplifier is high. When the binary register value is low, the bias current of the gamma amplifier is low.

Figure 7A:
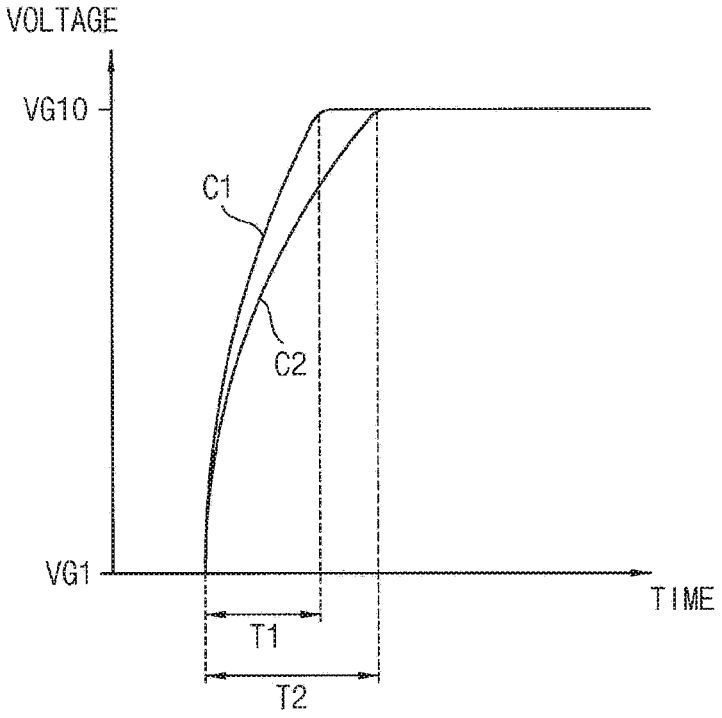
FIG. 7A is a graph illustrating a data voltage applied to the output buffer of FIG. 3 and increased from a first gamma voltage to a tenth gamma voltage.
Figure 7B:
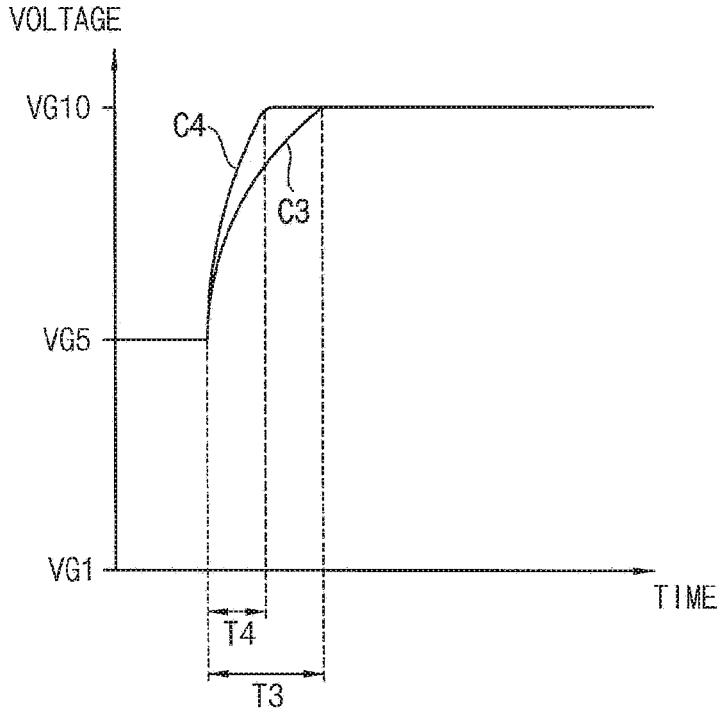
FIG. 7B is a graph illustrating a data voltage applied to the output buffer of FIG. 3 and increased from a fifth gamma voltage to the tenth gamma voltage.

FIG. 7A is a graph illustrating the data voltage VD1 applied to the output buffer 581 of FIG. 3 and increased from the first gamma voltage VG1 to the tenth gamma voltage VG10. FIG. 7B is a graph illustrating the data voltage VD1 applied to the output buffer 581 of FIG. 3 and increased from the fifth gamma voltage VG5 to the tenth gamma voltage VG10.

The change of the data voltage VD1 in FIG. 7A is greater than the change of the data voltage VD1 in FIG. 7B. When the bias current of the first gamma amplifier AMG1 is high, the data voltage VD1 according to time is represented as a first curve C1 in FIG. 7A. When the bias current of the first gamma amplifier AMG1 is low, the data voltage VD1 according to time is represented as a second curve C2 in FIG. 7A. In an exemplary embodiment, a time (e.g., T1) for the data voltage VD1 to reach an desired level, when the bias current of the first gamma amplifier AMG1 is high, is shorter than a time (e.g. T2) for the data voltage VD1 to reach the desired level, when the bias current of the first gamma amplifier AMG1 is low.

When the bias current of the first gamma amplifier AMG1 is high, a driving characteristic of the first gamma amplifier AMG1 may be high and a slew rate of a waveform of the gamma voltage output from the first gamma amplifier AMG1 may be great. However, when the bias current of the first gamma amplifier AMG1 is high, a power consumption of the first gamma amplifier AMG1 may be increased so that the power consumption of the display apparatus may be increased.

The change of the data voltage VD1 in FIG. 7B is less than the change of the data voltage VD1 in FIG. 7A. When the bias current of the fifth gamma amplifier AMG5 is high, the data voltage VD1 according to time is represented as a fourth curve C4 in FIG. 7B. When the bias current of the fifth gamma amplifier AMG5 is low, the data voltage VD1 according to time is represented as a third curve C3 in FIG. 7B. In an exemplary embodiment, a time (e.g., T4) for the data voltage VD1 to reach an desired level, when the bias current of the fifth gamma amplifier AMG5 is high, is shorter than a time (e.g. T3) for the data voltage VD1 to reach the desired level, when the bias current of the fifth gamma amplifier AMG5 is low.

When the bias current of the fifth gamma amplifier AMG5 is high, a driving characteristic of the fifth gamma amplifier AMG5 may be high and a slew rate of a waveform of the gamma voltage output from the fifth gamma amplifier AMG5 may be great. However, when the bias current of the fifth gamma amplifier AMG5 is high, a power consumption of the fifth gamma amplifier AMG5 may be increased so that the power consumption of the display apparatus may be increased.

Thus, when a maximum possible change of the first data voltage VD1 of the gamma amplifier (e.g. AMG1 and AMG10) is great, the bias current of the gamma amplifier may be set to be high. In contrast, when a maximum possible change of the first data voltage VD1 of the gamma amplifier (e.g. AMG5) is little, the bias current of the gamma amplifier may be set to be low.

In a present exemplary embodiment of the inventive concept, the gamma reference voltage generator 400 includes first gamma amplifiers generating first gamma reference voltages VGR corresponding to a first color image, second gamma amplifiers generating second gamma reference voltages VGG corresponding to a second color image and third gamma amplifiers generating third gamma reference voltages VGB corresponding to a third color image. The bias currents of the first gamma amplifiers may be set to be varied. For example, some of the first gamma amplifiers may be set to have different bias currents. The bias currents of the second gamma amplifiers may be set to be varied. For example, some of the second gamma amplifiers may be set to have different bias currents. The bias currents of the third gamma amplifiers may be set to be varied. For example, some of the third gamma amplifiers may be set to have different bias currents. In an exemplary embodiment, the bias currents of the first gamma amplifiers, the bias currents of the second gamma amplifiers and the bias currents of the third gamma amplifiers may be independently set.

According to the present exemplary embodiment, the bias current of the gamma amplifiers AMG1 to AMG10 is adjusted according to a data range of an image displayed on the display panel 100 to prevent the display quality of the display panel 100 from deteriorating and to reduce the power consumption of the display apparatus.

FIG. 8 is a table illustrating a method of setting bias currents of gamma amplifiers according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 1 to 7B except for the method of setting the bias currents of the gamma amplifiers. Thus, the same reference numerals will be used to refer to the same or like parts as those described in the previous exemplary embodiment of FIGS. 1 to 7B and any repetitive explanation concerning the above elements will be omitted.

Referring to FIGS. 1 to 5 and 8, the display apparatus includes a display panel 100 and a display panel driver. The display panel driver includes the driving controller 200, the gate driver 300, the gamma reference voltage generator 400 and the data driver 500.

The gamma reference voltage generator 400 includes a plurality of gamma amplifiers AMR1, AMR2, AMM, AMG1 to AMG10, a plurality of resistor strings and a plurality of registers REGM, REG1 to REG10 disposed between the gamma amplifiers AMR1, AMR2, AMM, AMG1 to AMG10 and the resistor strings.

In the present exemplary embodiment, the gamma amplifiers (e.g. AMG1 to AMG10) of the gamma reference voltage generator 400 are set to have varied bias currents.

In the present exemplary embodiment, the bias currents of the gamma amplifiers (e.g. AMG1 to AMG10) are varied according to luminance setting of the display panel 100.

For example, when a preset luminance of the display panel 100 is high, the bias currents of the gamma amplifiers (e.g. AMG1 to AMG10) are high. For example, when the preset luminance of the display panel 100 is low, the bias currents of the gamma amplifiers (e.g. AMG1 to AMG10) are low. In an exemplary embodiment, a bias current of a given gamma amplifier is a first current value when the preset luminance is a first luminance value and a second current value when the preset luminance is a second luminance value, where the first luminance value is higher than the second luminance value and the first current value is greater than or equal to the second current value.

The preset luminance may be directly set by a user of the display apparatus. Alternatively, the preset luminance may be automatically set by sensing an ambient luminance of the display apparatus in real time. For example, the display apparatus may include an ambient light sensor to sense the ambient luminance.

When the preset luminance is low, the range of the data signal to be displayed on the display panel 100 may be decreased. In contrast, when the preset luminance is high, the range of the data signal to be displayed on the display panel 100 may be increased.

Thus, as shown in FIG. 8, when the preset luminance of the display panel 100 is high (e.g. 100%), the levels of the bias currents may be generally high. In contrast, when the preset luminance of the display panel 100 is relatively low (e.g. 50%), the levels of the bias currents may be generally relatively low. For example, the bias current of the first gamma amplifier AMG1 may be 111 in the preset luminance of 100% and 110 in the preset luminance of 50%.

According to the present exemplary embodiment, the bias current of the gamma amplifier AMG1 to AMG10 is adjusted according to a data range of an image displayed on the display panel 100 to prevent the display quality of the display panel 100 from deteriorating and/or to reduce the power consumption of the display apparatus.

FIG. 9 is a table illustrating a method of setting bias currents of gamma amplifiers according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 1 to 7B except for the method of setting the bias currents of the gamma amplifiers. Thus, the same reference numerals will be used to refer to the same or like parts as those described in the previous exemplary embodiment of FIGS. 1 to 7B and any repetitive explanation concerning the above elements will be omitted.

Referring to FIGS. 1 to 5 and 9, the display apparatus includes the display panel 100 and the display panel driver. The display panel driver includes the driving controller 200, the gate driver 300, the gamma reference voltage generator 400 and the data driver 500.

The gamma reference voltage generator 400 includes a plurality of gamma amplifiers AMR1, AMR2, AMM, AMG1 to AMG10, a plurality of resistor strings and a plurality of registers REGM, REG1 to REG10 disposed between the gamma amplifiers AMR1, AMR2, AMM, AMG1 to AMG10 and the resistor strings.

In the present exemplary embodiment, the gamma amplifiers (e.g. AMG1 to AMG10) of the gamma reference voltage generator 400 are set to have varied bias currents.

In the present exemplary embodiment, the bias currents of the gamma amplifiers (e.g. AMG1 to AMG10) are varied according to a grayscale value of the input image data IMG.

For example, when a data range of the input image data IMG defined by the maximum grayscale value of the input image data IMG and the minimum grayscale value of the input image data IMG is wide, the bias currents of the gamma amplifiers (e.g. AMG1 to AMG10) is high. For example, when a data range of the input image data IMG defined by the maximum grayscale value of the input image data IMG and the minimum grayscale value of the input image data IMG is narrow, the bias currents of the gamma amplifiers (e.g. AMG1 to AMG10) is low.

When the difference between the maximum grayscale value and the minimum grayscale value is little, the variation of the data voltage outputted from the output buffer of the data driver 500 is little to prevent a quality of a displayed image from deteriorating even if the operating speed of the gamma amplifiers become slow. In contrast, when the difference between the maximum grayscale value and the minimum grayscale value is great, the variation of the data voltage outputted from the output buffer of the data driver 500 is great so that the operating speed of the gamma amplifiers is required to be fast to prevent the quality of the display image from deteriorating.

Thus, as shown in FIG. 9, when the difference between the maximum grayscale value and the minimum grayscale value of the display panel 100 is great (e.g., a mixed color image), the levels of the bias currents are generally high. In contrast, when the difference between the maximum grayscale value and the minimum grayscale value of the display panel 100 is little (e.g., a single color image), the levels of the bias currents are relatively low. For example, the bias current of a given gamma amplifier is a first current value when the difference between the maximum grayscale value and the minimum grayscale value is a first difference value, the bias current of the given gamma amplifier is a second current value lower or equal to the first current value when the difference is a second difference value lower than the first difference value. For example, the bias current of the first gamma amplifier AMG1 may be 111 in the mixed color image and 000 in the single color image.

For example, the data range of the input image data IMG defined by the maximum grayscale value of the input image data IMG and the minimum grayscale value of the input image data IMG may be determined in a unit of a frame of the input image data IMG. The bias currents of the gamma amplifiers may be updated in a unit of the frame. For example, the bias currents may be changed each time the vertical synchronizing signal indicates a new frame of the image data IMG is to be output to the display panel 100. For example, the vertical synchronizing signal received from the driving controller 200 may include a plurality of pulses, where a certain edge of each pulse corresponds to a new frame of the image data IMG.

Alternatively, the data range of the input image data IMG defined by the maximum grayscale value of the input image data IMG and the minimum grayscale value of the input image data IMG may be determined in a unit of a display line of the input image data IMG. The bias currents of the gamma amplifiers may be updated in a unit of the display line. For example, the bias currents may be changed each time the horizontal synchronizing signal indicates a new row of the image data IMG is to be output to the display panel 100. For example, the horizontal synchronizing signal received from the driving controller 200 may include a plurality of pulses, where a certain edge of each pulse corresponds to a new row of the image data IMG.

When the bias currents of the gamma amplifiers are updated in a unit of the display line, the bias currents may be optimized so that the power consumption is effectively reduced. However, when the bias currents of the gamma amplifiers are updated in a unit of the display line, an overload to update the bias currents may be generated.

According to the present exemplary embodiment, the bias current of the gamma amplifier AMG1 to AMG10 is adjusted according to a data range of an image displayed on the display panel 100 to prevent the display quality of the display panel 100 from deteriorating or to reduce the power consumption of the display apparatus.

Figure 10:
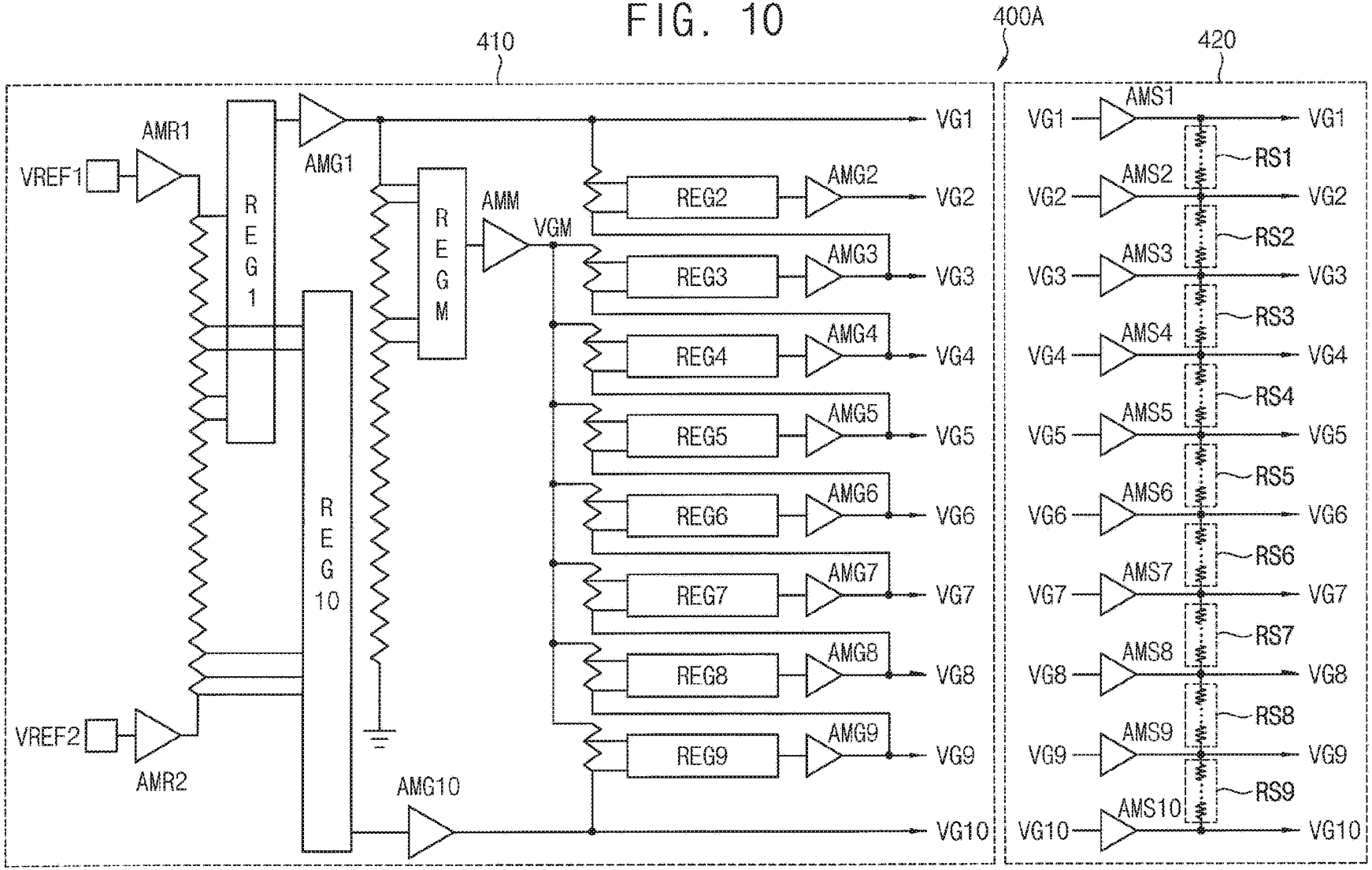
FIG. 10 is a circuit diagram illustrating a gamma reference voltage generator according to an exemplary embodiment of the present inventive concept.

FIG. 10 is a circuit diagram illustrating a gamma reference voltage generator 400A according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 1 to 7B except for the structure of the gamma reference voltage generator. Thus, the same reference numerals will be used to refer to the same or like parts as those described in the previous exemplary embodiment of FIGS. 1 to 7B and any repetitive explanation concerning the above elements will be omitted.

Referring to FIGS. 1 to 3, 5 to 7B and 10, the display apparatus includes the display panel 100 and the display panel driver. The display panel driver includes the driving controller 200, the gate driver 300, a gamma reference voltage generator 400A and the data driver 500.

The gamma reference voltage generator 400A includes a plurality of gamma amplifiers AMR1, AMR2, AMM, AMG1 to AMG10, a plurality of resistor strings and a plurality of registers REGM, REG1 to REG10 disposed between the gamma amplifiers AMR1, AMR2, AMM, AMG1 to AMG10 and the resistor strings.

In the present exemplary embodiment, the gamma reference voltage generator 400A includes a master gamma reference voltage generator 410 including master gamma amplifiers AMG1 to AMG10 outputting master gamma reference voltages VG1 to VG10 and a slave gamma reference voltage generator 420 including slave gamma amplifiers AMS1 to AMS10 receiving the master gamma reference voltages VG1 to VG10 and outputting the master gamma reference voltages VG1 to VG10 to the data driver 500 and slave resistor strings RS1 to RS10 disposed between the slave gamma amplifiers AMS1 to AMS10. In an exemplary embodiment of the inventive concept, the slave resistor strings RS1 to RS10 of the slave gamma reference voltage generator 420 output slave gamma reference voltages having levels between the master gamma reference voltages VG1 to VG10.

For example, the master gamma amplifiers AMG1 to AMG10 may correspond to the slave gamma amplifiers AMG1 to AMG10 one to one. In an exemplary embodiment, the output of the first master gamma amplifier AMG1 is provided to an input of the first slave gamma amplifier AMS1, the output of the second master gamma amplifier AMG2 is provided to an input of the second slave gamma amplifier AMS2, . . . , the output of the tenth master gamma amplifier AMG10 is provided to an input of the tenth slave gamma amplifier AMS10.

In an exemplary embodiment, the master gamma amplifier and the slave gamma amplifier which correspond to each other have the same bias current. For example, the bias current setting in FIG. 6 may be applied to both the master gamma amplifier and the slave gamma amplifier.

According to the present exemplary embodiment, the bias current of the gamma amplifier AMG1 to AMG10 is adjusted according to a data range of an image displayed on the display panel 100 to prevent the display quality of the display panel 100 from deteriorating and/or to reduce the power consumption of the display apparatus.

Figure 11:
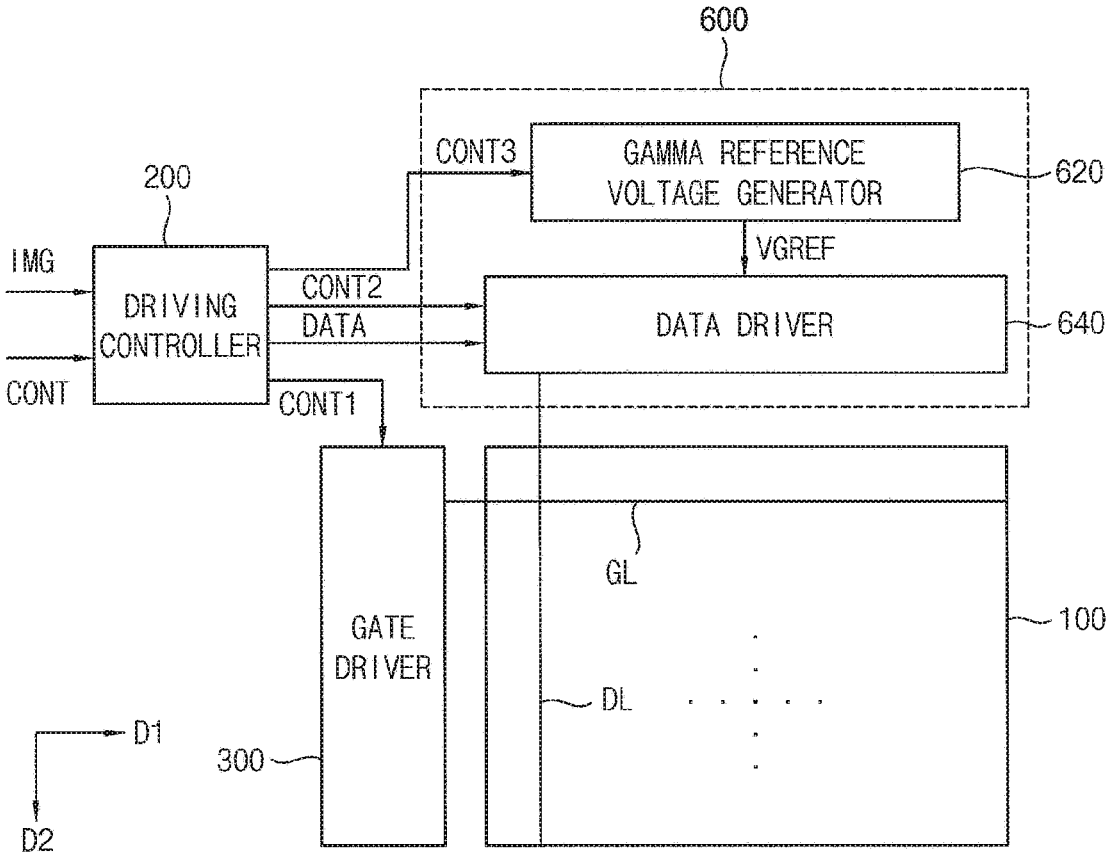
FIG. 11 is a block diagram illustrating a display apparatus according to an exemplary embodiment of the present inventive concept.

FIG. 11 is a block diagram illustrating a display apparatus according to an exemplary embodiment of the present inventive concept.

The display apparatus of FIG. 11 and the method of driving a display panel of the display apparatus of FIG. 11 according to the present exemplary embodiment is substantially the same as the display apparatus and the method of driving the display panel of the previous exemplary embodiment explained referring to FIGS. 1 to 7B except for the structure of the data driver and the gamma reference voltage generator. Thus, the same reference numerals will be used to refer to the same or like parts as those described in the previous exemplary embodiment of FIGS. 1 to 7B and any repetitive explanation concerning the above elements will be omitted.

Referring to FIGS. 2 to 7B and 11, the display apparatus includes a display panel 100 and a display panel driver. The display panel driver includes a driving controller 200, a gate driver 300, a gamma reference voltage generator 620 and a data driver 640.

In the present exemplary embodiment, the gamma reference voltage generator 620 and the data driver 640 form a single integrated data driver 600. For example, the gamma reference voltage generator 620 and the data driver 640 may be located on a single integrated circuit.

In the present exemplary embodiment, the gamma amplifiers (e.g. AMG1 to AMG10) of the gamma reference voltage generator 400 are set to have varied bias currents.

According to the present exemplary embodiment, the bias current of the gamma amplifier AMG1 to AMG10 is adjusted according to a data range of an image displayed on the display panel 100 to prevent the display quality of the display panel 100 from deteriorating and/or to reduce the power consumption of the display apparatus.

According to at least one exemplary embodiment of the display apparatus and the method of driving the display panel, the bias currents of the gamma amplifiers may be adjusted so that the power consumption of the display apparatus is reduced.

The foregoing is illustrative of exemplary embodiments of the present inventive concept and is not to be construed as limiting thereof. Although a few exemplary embodiments of the present inventive concept have been described, many modifications are possible in the exemplary embodiments without materially departing from the present inventive concept. Accordingly, all such modifications are intended to be included within the scope of the present inventive concept.

What is claimed is:

1. A display apparatus comprising:

a display panel configured to display an image based on input image data;

a gate driver configured to output a gate signal to the display panel;

a data driver configured to output a data voltage to the display panel; and a gamma reference voltage generator comprising a plurality of gamma amplifiers having varied bias currents, the gamma reference voltage generator configured to generate gamma reference voltages and to output the gamma reference voltages to the data driver, wherein the bias currents gradually increase from a first middle of the gamma amplifiers to a first one of the gamma amplifiers and gradually increase from a second middle of the gamma amplifiers to a last one of the gamma amplifiers.

2. The display apparatus of claim 1, wherein the gamma amplifiers comprise:

a minimum gamma amplifier configured to output a minimum gamma reference voltage;

a maximum gamma amplifier configured to output a maximum gamma reference voltage; and a middle gamma amplifier configured to output a middle gamma reference voltage between the minimum gamma reference voltage and the maximum gamma reference voltage, wherein a bias current of the maximum gamma amplifier is greater than a bias current of the middle gamma amplifier, and wherein a bias current of the minimum gamma amplifier is greater than the bias current of the middle gamma amplifier.

3. The display apparatus of claim 1, wherein the bias currents of the gamma amplifiers are varied according to a preset luminance of the display panel.

4. The display apparatus of claim 3, wherein when the preset luminance of the display panel is a first luminance value, the bias current of a given one of the gamma amplifiers is a first current value, and wherein when the preset luminance of the display panel is a second luminance value lower than the first luminance value, the bias current of the given one gamma amplifier is a second current value lower than the first current value.

5. The display apparatus of claim 1, wherein the bias currents of the gamma amplifiers are varied according to grayscale values of the input image data.

6. The display apparatus of claim 5, wherein when a difference between a maximum grayscale value of the input image data and a minimum grayscale value of the input image data is a first difference value, the bias current of a given one the gamma amplifiers is a first current value, and wherein when the difference between the maximum grayscale value of the input image data and the minimum grayscale value of the input image data is a second difference value lower than the first difference value, the bias current of the given one gamma amplifier is a second current value lower than the first current value.

7. The display apparatus of claim 6, wherein the difference between the maximum grayscale value of the input image data and the minimum grayscale value of the input image data is determined in a unit of a frame of the input image data, and wherein the bias currents of the gamma amplifiers are updated in the unit of the frame.

8. The display apparatus of claim 6, wherein the difference between the maximum grayscale value of the input image data and the minimum grayscale value of the input image data is determined in a unit of a display line of the input image data, and wherein the bias currents of the gamma amplifiers are updated in the unit of the display line.

9. The display apparatus of claim 1, wherein the gamma amplifiers comprise first gamma amplifiers configured to generate first gamma reference voltages corresponding to a first color image, second gamma amplifiers configured to generate second gamma reference voltages corresponding to a second color image and third gamma amplifiers configured to generate third gamma reference voltages corresponding to a third color image, and wherein the first gamma amplifiers have varied bias currents, the second gamma amplifiers have varied bias currents and the third gamma amplifiers have varied bias currents.

10. The display apparatus of claim 1, wherein the gamma reference voltage generator further comprises:

a plurality of resistor strings; and a plurality of registers disposed between the gamma amplifiers and the resistor strings, and wherein an output voltage of a given one of the gamma amplifiers is determined by a value stored in a corresponding one of the registers.

11. The display apparatus of claim 10, wherein the gamma reference voltage generator comprises:

a master gamma reference voltage generator comprising the plurality of gamma amplifiers as master gamma amplifiers configured to output master gamma reference voltages; and a slave gamma reference voltage generator comprising a plurality of slave gamma amplifiers configured to receive the master gamma reference voltages and to output the master gamma reference voltages to the data driver and a plurality of slave resistor strings disposed between the slave gamma amplifiers.

12. The display apparatus of claim 11, wherein the master gamma amplifiers correspond to the slave gamma amplifiers one to one.

13. The display apparatus of claim 12, wherein the master gamma amplifier and the slave gamma amplifier which correspond to each other have a same bias current.

14. The display apparatus of claim 1, wherein the gamma reference voltage generator and the data driver form a single integrated data driver.

15. A method of driving a display panel, the method comprising:

outputting a gate signal to a display panel;

generating a plurality of gamma reference voltages using a plurality of gamma amplifiers having varied bias currents; and outputting a data voltage to the display panel based on input image data and the gamma reference voltages, wherein the gamma amplifiers comprise:

a minimum gamma amplifier configured to output a minimum gamma reference voltage;

a maximum gamma amplifier configured to output a maximum gamma reference voltage; and a middle gamma amplifier configured to output a middle gamma reference voltage between the minimum gamma reference voltage and the maximum gamma reference voltage, wherein a bias current of the maximum gamma amplifier is greater than a bias current of the middle gamma amplifier, and wherein a bias current of the minimum gamma amplifier is greater than the bias current of the middle gamma amplifier.

16. The method of claim 15, wherein the bias currents of the gamma amplifiers are varied according to preset luminance of the display panel.

17. The method of claim 16, wherein when the preset luminance of the display panel is a first luminance value, the bias current of a given one of the gamma amplifiers is a first current value, and wherein when the preset luminance of the display panel is a second luminance value lower than the first luminance value, the bias current of the given one gamma amplifier is lower than the first current value.

18. The method of claim 15, wherein the bias currents of the gamma amplifiers are varied according to grayscale values of the input image data.

19. The method of claim 18, wherein when a difference between a maximum grayscale value of the input image data and a minimum grayscale value of the input image data is a first difference value, the bias current of a given one of the gamma amplifiers is a first current value, and wherein when the difference between the maximum grayscale value of the input image data and the minimum grayscale value of the input image data is a second difference value lower than the first difference value, the bias current of the given one gamma amplifier is a second current value lower than the first current value.

20. A driving controller for driving a display panel of a display apparatus, the driving controller comprising:

a gamma reference voltage generator configured to generate gamma reference voltages and to output the gamma reference voltages; and a data driver converts image data into data voltages having an analog type using the gamma reference voltages, wherein the gamma reference voltage generator comprises:

a minimum gamma amplifier configured to output a minimum gamma reference voltage of gamma reference voltages;

a maximum gamma amplifier configured to output a maximum gamma reference voltage gamma reference voltages; and a middle gamma amplifier configured to output a middle gamma reference voltage of the gamma reference voltages between the minimum gamma reference voltage and the maximum gamma reference voltage, wherein a bias current of the maximum gamma amplifier is greater than a bias current of the middle gamma amplifier, and wherein a bias current of the minimum gamma amplifier is greater than the bias current of the middle gamma amplifier.

21. The driving controller of claim 20, where the bias currents are varied according to a preset luminance of the display panel.

22. The driving controller of claim 20, wherein the bias currents are varied according to grayscale values of the image data.

23. The display apparatus of claim 1, where the bias current of the first middle gamma amplifier is the same as the bias current of the second middle gamma amplifier.

* * * * *